United States Patent [19]

Boehland et al.

[11] Patent Number: 4,505,000

[45] Date of Patent: Mar. 19, 1985

[54] CHIMNEY CLEANING APPARATUS

[75] Inventors: Burnell G. Boehland, Creswell; Donald G. Coutts, Eugene, both of Oreg.

[73] Assignee: Speedy Automatic Chimney Sweep, Inc., Eugene, Oreg.

[21] Appl. No.: 606,533

[22] Filed: May 3, 1984

Related U.S. Application Data

[63] Continuation-in-part of Ser. No. 580,938, Feb. 16, 1984, abandoned.

[51] Int. Cl.[3] ..... F23J 3/00

[52] U.S. Cl. ..... 15/249; 15/163

[58] Field of Search ..... 15/162, 163, 242, 243, 15/249, 104.2; 126/16

[56] References Cited

U.S. PATENT DOCUMENTS

| | | | |
|---|---|---|---|
| 564,988 | 8/1896 | Gerard | 15/249 |
| 946,129 | 1/1910 | Harms | 15/249 |
| 1,859,166 | 5/1932 | Premro | 15/163 |

FOREIGN PATENT DOCUMENTS

| | | | |
|---|---|---|---|
| 2327296 | 1/1975 | Fed. Rep. of Germany | 15/163 |

*Primary Examiner*—Peter Feldman

*Attorney, Agent, or Firm*—James D. Givnan, Jr.

[57] ABSTRACT

A chimney cleaning apparatus having a base including a housing spaced above a chimney upper end by upright supports, a support structure depending from the base into that portion of the chimney to be cleaned. A reversible electric motor powers a cable carried brush along chimney surfaces with the brush carried by rotatable members on said base and at the lower end of the support structure. The support structure is adjustably coupled to the base to permit tensioning of the cable. A brush drive assembly includes a motor and speed reducer unit which drives a switch closing arm in opposite directions to establish and interrupt motor circuits. An arm assembly of a modified support structure is swingably mounted on a support structure post and swings horizontally to facilitate centering of the brush in the chimney.

9 Claims, 5 Drawing Figures

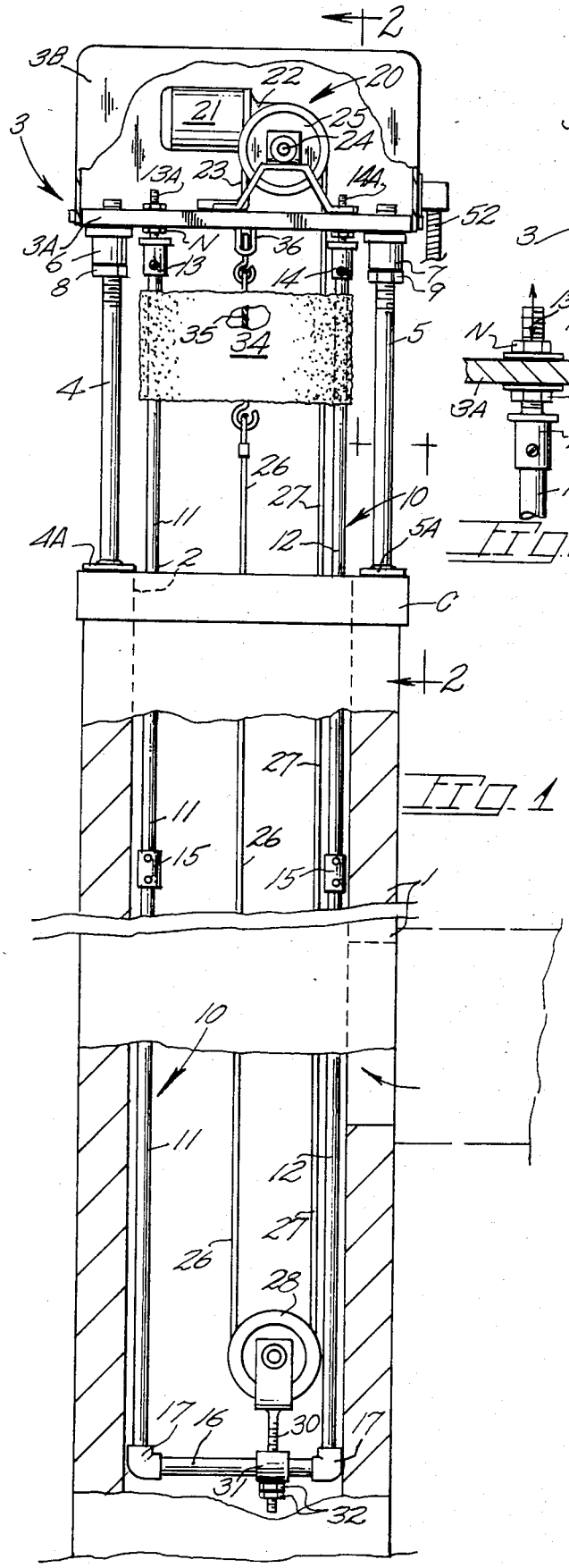
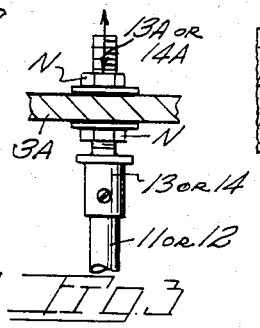
FIG. 3
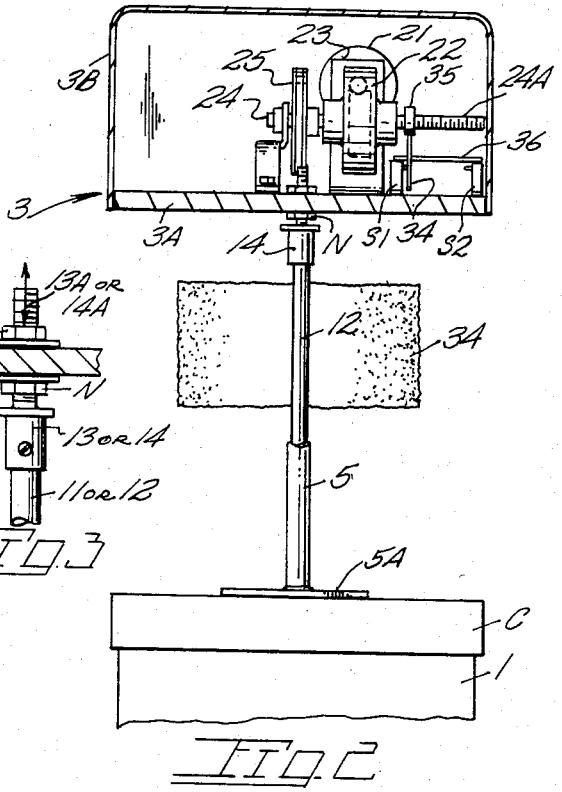
FIG. 2
FIG. 1
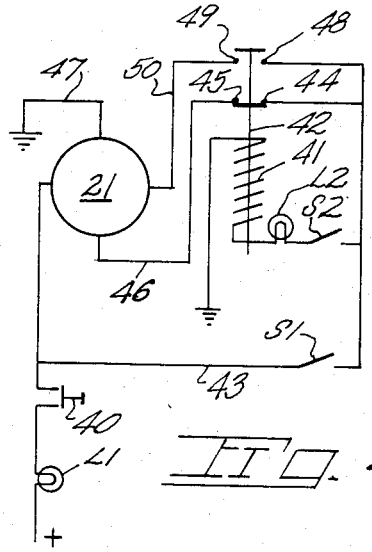
FIG. 4

CHIMNEY CLEANING APPARATUS

BACKGROUND OF THE INVENTION

The present application is a continuation-in-part application to our earlier application of this same title filed Feb. 16, 1984, under Ser. No. 580,938, now abandoned.

The present invention pertains to an apparatus for installation within a chimney or other exhaust conduit for the purpose of periodically cleaning same.

Chimney fires most often result from an accumulation of creosote deposits deposited along chimney walls. In the interest of fire prevention, homeowners are encouraged to have these deposits removed once or twice a year which task is usually accomplished with a long handled brush from the upper end of the chimney. Over a period of time, periodic chimney cleaning amounts to a substantial expense to the homeowner as it is not a task easily performed by the typical homeowner. Further, special equipment is required for manually performing chimney cleaning.

The known prior art includes the concept of propelling a brush through a smoke conduit by means of a flexible, powered arrangement such as a cable or chain. A lowermost pulley or sprocket must be positioned in a stationary manner within the chimney. Prior applications filed by the present inventors, Ser. No. 530,781, now U.S. Pat. No. 4,483,038, and No. 549,882, disclose chimney cleaning apparatuses which are inserted into the chimney (or other smoke conduit) and obviate structural modification of same. Common to both of the noted applications is the concept of a brush entrained on a rigid guide member centrally disposed within the chimney. Also within the prior art is the concept of propelling a chimney cleaning brush by a tensioned cable or chain such as disclosed in U.S. Pat. Nos. 707,713 and 4,340,989. The above noted patented apparatuses or the subject matter of the noted applications do not utilize a framework positionable within the chimney nor a swingably mounted arm assembly positionable within a chimney to facilitate brush travel through the chimney.

SUMMARY OF THE PRESENT INVENTION

The present invention is embodied within a chimney cleaning apparatus including a support structure for installation within a chimney or the like.

A base of the present apparatus is spaced downwardly from the exhaust end of a chimney and supports drive means for propelling a brush along the chimney opening. Additionally on the base are motor controls which are set to determine the range of brush travel. The support structure inserted into the chimney serves to support a pulley or other rotatable member about which a brush carrying flexible elongate member is entrained.

Important objects of the present apparatus include the provision of a chimney cleaning apparatus utilizing lightweight, low cost support structure which supports the remaining components and permits convenient assembly and installation within a chimney; the provision of a chimney cleaning apparatus which is readily adaptable to different lengths and cross sectional shapes and sizes of chimneys to be cleaned; the provision of such an apparatus which enables tensioning of the brush carrying cable or chain after installation of the apparatus; the provision of such an apparatus wherein an arm assembly of a support structure post automatically positions itself about said post of the support structure.

BRIEF DESCRIPTION OF THE DRAWING

In the accompanying drawing:

FIG. 1 is an elevational view of a chimney sectioned for purposes of illustration with the present apparatus in place therein;

FIG. 2 is a vertical sectional view taken along irregular line 2—2 of FIG. 1;

FIG. 3 is an enlarged fragmentary view of a framework member adjustably mounted on a base of the apparatus;

FIG. 4 is an electrical schematic of a motor control circuit; and

DETAILED DESCRIPTION OF THE PREFERRED EMBODIMENT

Figure 5:
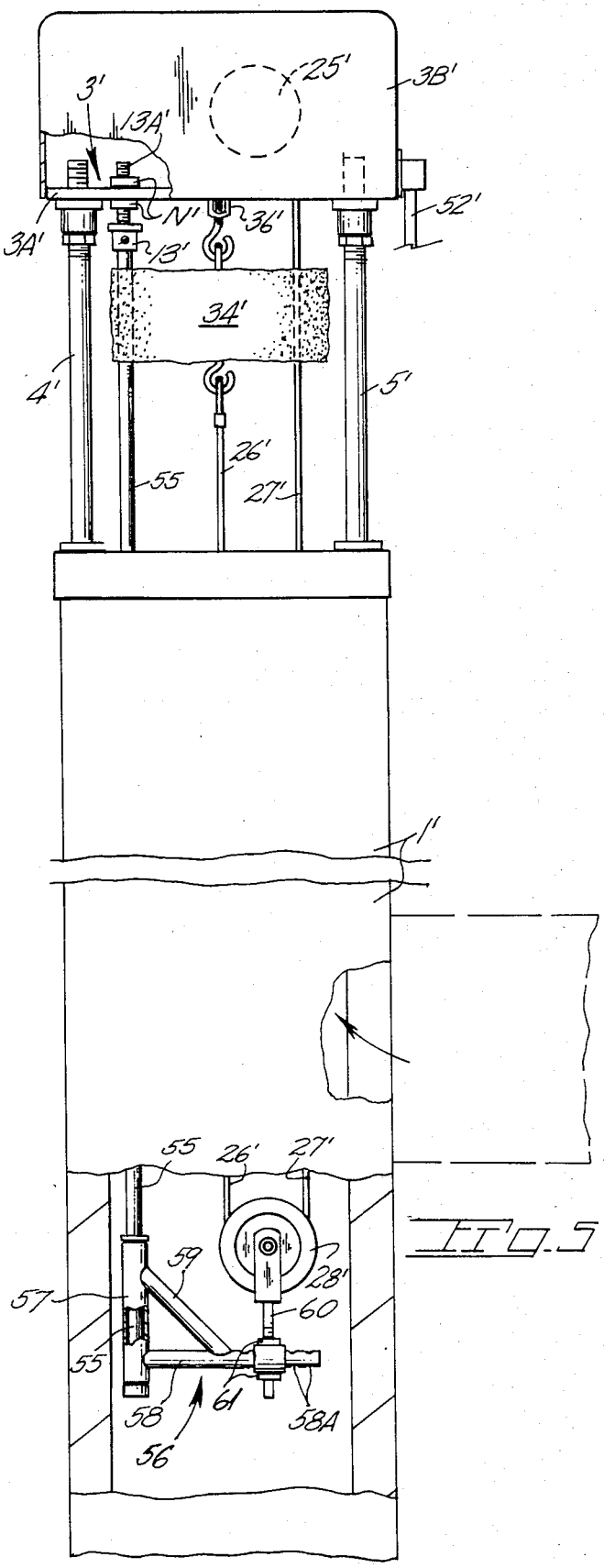
FIG. 5 is a view similar to FIG. 1 but showing a modified form of the invention.

With continuing attention to the drawing wherein applied reference numerals indicate parts hereinafter similarly identified, the reference numeral 1 indicates a smoke conduit such as a chimney, smokestack, exhaust pipe, etc., through which the products of combustion are vented to the atmosphere through an opening 2.

A base of the present apparatus is indicated generally at 3 and includes a platform 3A in spaced elevation from the chimney end 2 by means of upright supports 4 and 5. Said base includes support receiving mounts 6 and 7 with nut elements 8 and 9 serving to maintain the base in a desired spaced relationship with the chimney end. Each support has a plate 4A–5A in engagement with a chimney cap C. A base housing at 3B is removably mounted on base 3A.

A support structure indicated generally at 10 depends from platform 3A and, in the preferred form of the invention, comprises a framework having elongate members 11 and 12 which are preferably of tubular construction. Base mounted sockets 13 and 14 include set screws for framework retention. The sockets are each adjustably mounted by a threaded shaft 13A–14A and nut elements N thereon to provide adjustable framework mounting means. Couplings as at 15 serve to join the ends of framework members to enable convenient framework assembly at an installation site and of any length desired. A framework cross member is at 16 carried by elbow fittings at 17.

A brush drive assembly is indicated generally at 20 and includes a reversible electric motor 21 having a worm drive speed reducer unit 22 in place on a motor mount 23. A right angular output shaft 24 of the speed reducer carries a pulley 25 about which is reeved a flexible member such as a cable or chain having runs 26 and 27 which pass through openings (not shown) in base platform 3A. The lower end of the flexible element is reversed about a pulley 28 adjustably supported by framework cross member 16 by means of a threaded shaft 30 passing through a sleeve 31 on said cross member and receiving jam nuts 32.

A brush at 34 is shown as being of wire bristles of a size to scrape the chimney walls to dislodge chimney deposits. The cable or chain runs are attached to a brush stem 35 having eyes formed at the stem ends. A turnbuckle is at 36.

A motor control circuit includes first and second limit switches S1 and S2 mounted on platform 3A in the path of a traveling arm 34 carried by a threaded collar 35 in traveling engagement with a threaded output shaft segment 24A having a fine pitch. Shaft segment 24A is driven by reversible motor 21 to advance arm 34 therealong into switch contact at extremes of arm travel. Movement of arm 34 in each direction is concurrent and coterminous with brush travel in each direction. Guide means 36 stabilizes traveling arm 34 against rotary movement.

With reference to the schematic of FIG. 4, the motor control circuit includes a start switch 40 which, upon momentary closure by an operator, initiates motor operation to the extent a sustaining current flow for motor operation is established through now closed first limit switch S1. Later closure of switch S2 by arm 34 (at the limit of downward brush movement) energizes a relay 41 with its armature 42 moving to the first circuit which includes limit switch S1, line 43, contacts 44–45 and a motor lead 46. A motor ground wire is at 47. Simultaneously with breaking of the first circuit is the establishment of a second circuit including armature closed contacts 48–49 and a motor lead 50. Accordingly, at the lower limit of brush travel, switch S2 is closed to energize relay 41 to establish the second circuit to the motor whereupon speed reducer output shaft 24 will now be driven in an opposite direction to return the brush component to a raised, stowed position which occurs when first limit switch S1 is opened by arm 34 returning to its start position shown. A light L1 is on during motor operation in one direction while light L2 indicates reverse operation of the motor. The electrical components are served by an electrical conduit 52 which permits the electrical components, for the most part, to be located remote from the chimney end.

It is to be understood that the flexible member 26–27 may be embodied in a wire rope such as stainless steel cable, or alternatively, a chain in which instance upper and lower sprockets are substituted for pulleys 25 and 28. The upright supports 4 and 5 may be equipped with feet shaped other than those shown as, for example, feet which may be clamped into chimney cap engagement by a common fastening means.

A modified support structure is shown in FIG. 5 wherein the earlier described framework is dispensed with and a single post 55 utilized instead. Said post depends from a base platform 3A′ in the adjustable manner earlier described with upright supports 4 and 5 and shown in FIG. 3. Prime reference numerals and letters indicate parts analogous to the earlier described components. Post 55 depends from base platform 3A′ and a socket 13′. An arm assembly, generally at 56 may include pivot means shown as a sleeve 57 in place on a post lower end segment. An arm 58 is braced at 59 and supports a clevis equipped shaft 60 in which clevis is carried a lower pulley 28′. Arm 58 is adapted to receive shaft 60 within one of several openings 58A therethrough. Nut elements 61 adjust and lock the clevis mounted pulley in place. The modified support structure, when equipped with said pivot means, may swing in a horizontal plane about the axis of post 55 and thereby permit pulley 28′ to automatically position itself in response to forces exerted thereon by flexible members 26′ and 27′ as the brush 34′ approaches its lower limit of travel. Accordingly, arm assembly 56 assumes a position conducive to a full range of brush travel.

While we have shown but a few embodiments of the invention it will be apparent to those skilled in the art that the invention may be embodied still otherwise without departing from the spirit and scope of the invention.

Having thus described the invention, what is desired to be secured under a Letters Patent is:

We claim:

1. A chimney cleaning apparatus comprising,
a base for supported placement on a chimney,
a support structure carried by said base and extending downwardly therefrom for lengthwise disposition within a chimney,
a brush assembly including a brush, a flexible elongate element attached to said brush,
a first rotatable member carried by said base,
a second rotatable member carried by said support structure adjacent one end thereof, said flexible element entrained about said first rotatable member and said second rotatable member,
reversible motor means carried by said base to impart rotation to said first rotatable member to propel said brush in a rectilinear manner through the chimney, and
a motor circuit in switch controlled circuit with a power source and with said motor to energize same for predetermined periods of motor operation in each direction whereby the brush assembly will dislodge chimney deposits with the brush coming to rest at an elevated position subjacent said base.

2. The chimney cleaning apparatus claimed in claim 1 additionally including adjustable mounting means coupling said support structure to said base whereby said support structure and said second rotatable member may be positioned relative said base to tension said flexible element.

3. The apparatus claimed in claim 1 wherein said support structure includes a framework comprising a pair of elongate members and said second rotatable member carried by a cross member between said pair of elongate members.

4. The apparatus claimed in claim 1 wherein said reversible motor means includes speed reducing means, a switch actuating arm driven by said speed reducing means in a rectilinear manner,
said motor control circuit including first and second limit switches contactible by said arm to alternately establish and interrupt circuits to said reversible motor means.

5. The apparatus claimed in claim 1 additionally including upright supports for engagement at their lower ends with a chimney cap.

6. The apparatus claimed in claim 5 wherein said upright supports are in adjustable engagement with said base to permit altering the position of said base with respect to the chimney upper end.

7. The apparatus claimed in claim 1 wherein said support structure includes a post, and arm assembly including pivot means in place on said post, said second rotatable member carried by said arm assembly for movement in a horizontal plane in response to lateral displacement of the flexible elongate element by said brush.

8. The apparatus claimed in claim 1 wherein said support structure includes a post adapted to be located within the chimney to be cleaned and offset from the chimney major axis, an arm assembly in place on the lower end of said post, said second rotatable member carried by said arm assembly.

9. The apparatus claimed in claim 8 additionally including adjustable mounting means coupling said support structure to said base whereby said post may be axially positioned relative said base.

* * * * *